United States Patent [19]

Goldberg et al.

[11] Patent Number: 5,005,478

[45] Date of Patent: Apr. 9, 1991

[54] BLANKET WASH SYSTEM WITH SUB-AMBIENT PRESSURE CIRCULATION

[75] Inventors: Edward M. Goldberg, Waterford, Conn.; Daniel Bettencourt, Jr., West Warwick, R.I.; James C. Tosti, Jr., Pawcatuck, Conn.; Norman S. Jones, Peacedale, R.I.

[73] Assignee: Precision Engineered Systems Inc., Westerly, R.I.

[21] Appl. No.: 384,966

[22] Filed: Jul. 25, 1989

Related U.S. Application Data

[63] Continuation-in-part of Ser. No. 134,218, Dec. 16, 1987, abandoned, which is a continuation-in-part of Ser. No. 86,330, Aug. 17, 1987, abandoned, and a continuation-in-part of Ser. No. 926,379, Oct. 31, 1986, Pat. No. 4,686,902.

[51] Int. Cl.[5] ..... B41F 35/00

[52] U.S. Cl. ..... 101/425; 137/563; 239/125; 340/605

[58] Field of Search ..... 101/425; 239/124, 125; 137/563; 340/605

[56] References Cited

U.S. PATENT DOCUMENTS

| | | | |
|---|---|---|---|
| 3,227,377 | 1/1966 | Bartel | 239/124 |
| 3,462,300 | 8/1969 | Hocutt | 101/425 X |
| 3,508,711 | 4/1970 | Switall | 101/425 X |
| 3,546,667 | 2/1970 | Thomas | 340/605 X |
| 3,637,136 | 1/1972 | Bok | 239/125 |
| 3,939,383 | 2/1976 | Alm | 340/605 X |
| 4,281,620 | 8/1981 | McChesney et al. | 137/563 X |
| 4,686,902 | 8/1987 | Allain et al. | 137/563 X |

*Primary Examiner*—Clifford D. Crowder
*Attorney, Agent, or Firm*—Bromberg & Sunstein

[57] ABSTRACT

An enhanced system for cleaning a component, such as a blanket, of a printing press in one embodiment provides circulation of wash mixture around a path in such a way that pressure of fluid in the supply line can never exceed ambient pressure. This may be achieved, for example, by utilizing a pump disposed in the return line (rather than in the supply line). Another embodiment provides a spray arrangement for spraying wash mixture onto the component to be cleaned. The spray arrangement has nozzles that are in communication with a feed region (such as the interior of a spray bar) and an isolation valve arrangement for in an open state permitting and in a closed state preventing fluid pressure transmission from the rest of the system to the feed region. A pressure arrangement modifies fluid pressure in the feed region when the isolation valve arrangement is in a closed state. The pressure may be modified so that when the spray arrangement is being prepared for spraying, the pressure is increased above ambient pressure. At other times, the pressure may be below ambient pressure. The pressure arrangement may be realized by a cylinder-piston system, wherein the piston is biased in a first direction to increase the pressure and in a second direction to decrease the pressure.

28 Claims, 8 Drawing Sheets

| MODE | SV4 | SV1 | SV-2 | SV-3 UPPER | SV-3 LOWER | PS1 | SV10 | LTS1 |
|---|---|---|---|---|---|---|---|---|
| NO POWER | CLOSED | CLOSED | CLOSED | CLOSED | CLOSED | N.C. | CLOSED | N.C. |
| START | | | | | | | | |
| **NORMAL AND LEAK CHECK | CLOSED | CLOSED | OPEN | CLOSED | CLOSED | CLOSED | OPEN | CLOSED |
| FLOW-THRU | OPEN | | | | | | CLOSED | OPEN |
| PURGE CYL A<br>B | | OPEN<br>CLOSES | CLOSED<br>OPENS | | | | | CLOSES<br>OPENS |
| PRESSURIZE A<br>B | CLOSES | OPENS | CLOSES | | | OPEN | OPENS<br>* | |
| WASH BLANKETS A<br>B<br>C | | | | OPENS<br>CLOSES | OPENS<br>CLOSES | | | CLOSES |
| RELIEVE PRESSURE | OPENS | | | | | CLOSES | | |
| NORMAL AND LEAK CHECK A<br>B | CLOSED | CLOSED | OPENS | CLOSED | CLOSED | CLOSED | OPEN | CLOSED |

**LTS -1 OPEN IF LEAK OCCURS
*AFTER ALL UNITS ARE PURGED

FIG. 3

BLANKET WASH SYSTEM WITH SUB-AMBIENT PRESSURE CIRCULATION

DESCRIPTION

This application is a continuation in part of U.S. application Ser. No. 134,218, filed Dec. 16, 1987, now abandoned. U.S. Ser. No. 134,218 was a continuation in part of application Ser. No. 086,330, filed Aug. 17, 1987, now abandoned which in turn was a continuation in part of application Ser. No. 926,379, filed Oct. 31, 1986, which issued as U.S. Pat. No. 4,686,902. The foregoing applications are hereby incorporated herein by reference.

TECHNICAL FIELD

The present invention relates to systems for automatically cleaning blankets and similar components of printing presses.

BACKGROUND ART

Pertinent prior art is discussed in the above abandoned Ser. No. 134,218, and includes systems disclosed in U.S. Pat. Nos. 4,344,361, and 3,486,448, and 3,508,711. Chemicals used in automatic blanket wash systems are the subject of U.S. Pat. No. 4,829,897, assigned to Printex Products Corporation.

DISCLOSURE OF INVENTION

The present invention provides an enhanced system for cleaning a component, such as a blanket, of a printing press. One embodiment of the invention provides circulation of wash mixture around a path in such a way that pressure of fluid in the supply line can never exceed ambient pressure. This may be achieved, for example, by utilizing a pump disposed in the return line (rather than in the supply line). Another embodiment of the invention provides a spray arrangement for spraying wash mixture onto the component to be cleaned. The spray arrangement has nozzles that are in communication with a feed region (such as the interior of a spray bar) and an isolation valve arrangement for in an open state permitting and in a closed state preventing fluid pressure transmission from the rest of the system to the feed region. A pressure arrangement modifies fluid pressure in the feed region when the isolation valve arrangement is in a closed state. The pressure may be modified so that when the spray arrangement is being prepared for spraying, the pressure is increased above ambient pressure. At other times, the pressure may be below ambient pressure. The pressure arrangement may be realized by a cylinder-piston system, wherein the piston is biased in a first direction to increase the pressure and in a second direction to decrease the pressure.

BRIEF DESCRIPTION OF THE DRAWINGS

These and other features of the invention may be more readily understood by reference to the following description taken with the accompanying drawings, in which:

FIG. 3 shows a state diagram of the components of FIGS. 1 and 2 under various conditions in the operation of the embodiments of FIGS. 1 and 2;

DETAILED DESCRIPTION OF SPECIFIC EMBODIMENTS

Figure 1:
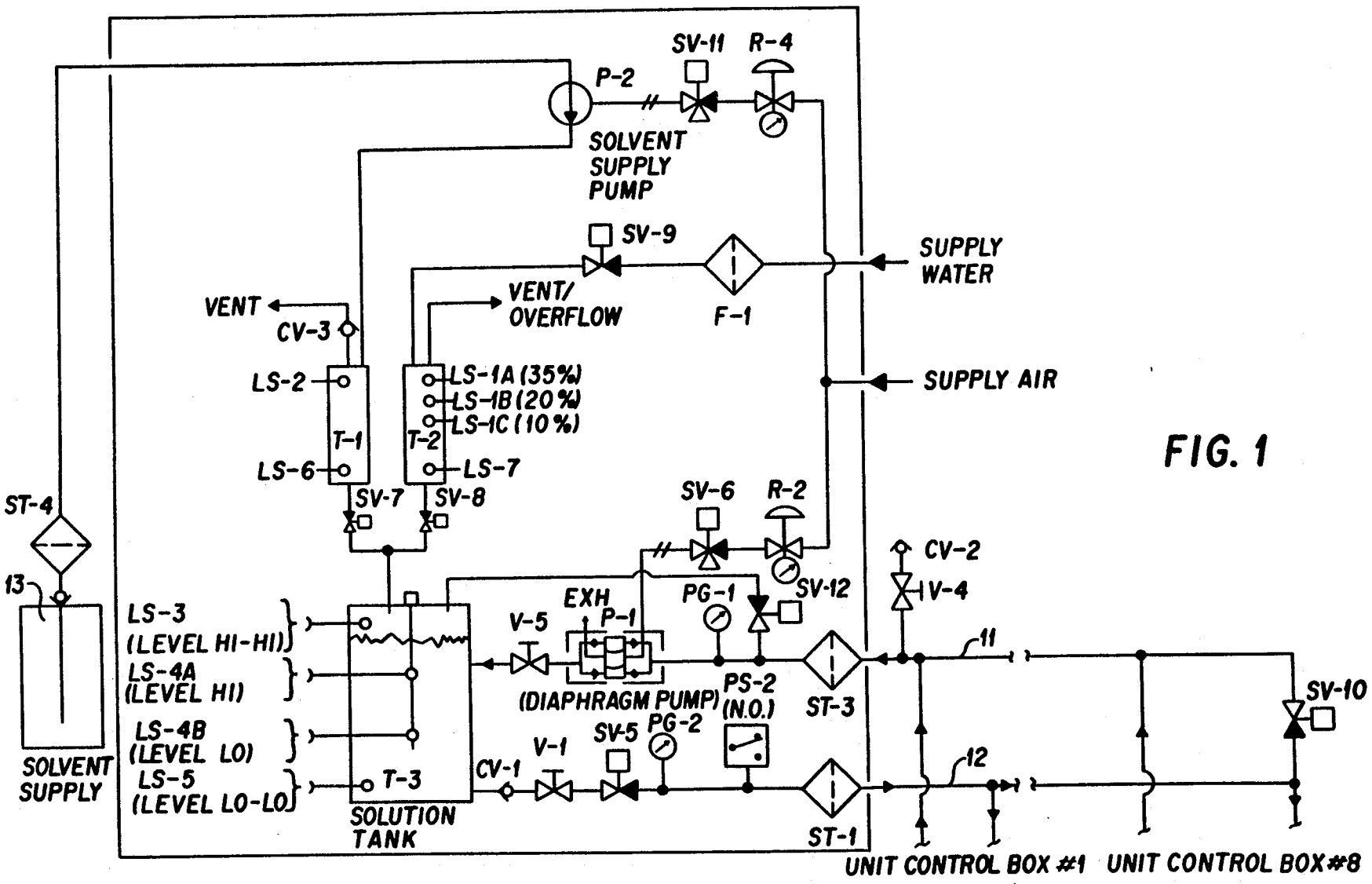
FIG. 1 shows a diagram of the basic fluid flow in a preferred embodiment of the invention.

Referring now to FIG. 1, there is shown a diagram of the basic fluid flow in a preferred embodiment of the invention, with particular detail of the circulator. A wash mixture is furnished to mixing tank T-3 in a manner discussed below. Typically chemicals used for automatic blanket wash systems are a mixture of hydrocarbon-based solvents and water and require some agitation to remain mixed. The invention described herein is suitable for such chemicals, although it may also be used for washing chemicals that do not require agitation. The entire system described herein is controlled by a programmable logic controller, such as the Series 1 Plus model available from General Electric, Schenectady, New York. The controller may also be custom built. In each case, however, what is critical is not the specific circuitry of the controller but rather the particular timing signals (illustrated in FIG. 4) delivered by the controller and the controller's ability to modify its outputs as a function of various inputs such as described in connection with FIG. 5.

Mixing tank T-3 is filled from chemical measuring tank T-1 and water measuring tank T-2 when more wash mixture is needed. (Alternatively, mixing tank T-3 could be filled in accordance with the techniques described in connection with FIG. 2 of U.S. Pat. No. 4,686,902, which discloses the use of a solution density sensor 261 for control of mixture density.) Level switch LS-2 indicates to the controller when chemical tank T-1, which has a capacity of 3 quarts, is full and level switch LS-6 indicates when the tank T-1 is empty. (All the limit switches described herein are monitored by the controller, and similarly, all of the solenoid-actuated valves described herein are actuated by the controller.) Similarly, level switch LS-7 indicates to the controller when water tank T-2 is empty and level switches LS-1-A, LS-1-B, and LS-1-C indicate when tank T-2 is full for a given (selected) mix ratio. In particular, LS-1-A is at 1.05 quarts, corresponding to 35%; LS-1-B is at 0.6 quart, corresponding to 20%; and LS-1-C is at 0.3 quart, corresponding to 10%. It will be apparent that these capacities and percentages are illustrative and that other capacities and percentages may readily be substituted.

In operation, the chemical is stored in chemical reservoir 13 and is pumped by pump P-2 through strainer ST-4 into the chemical measuring tank T-1. The pump P-2 is air driven via solenoid valve SV-11 (normally closed) and regulator valve R-4. Tank T-2 is filled by the house water supply via normally closed solenoid valve SV-9 and filter F-1.

Solenoid valves SV-7 and SV-8 permit the controller to dump the contents of tanks T-1 and T-2 respectively into mixing tank T-3. The dump function is initially verified by the change of state of level switches LS-2 (in tank T-1) and (in tank T-2) LS-1-A, LS-1-B, and/or LS-1-C, and is confirmed thereafter by LS-6 and LS-7.

Failure to completely dump (and/or to begin to dump) within times specified in the controller results in a solution error indication, and no further batches will be made.

The refill function of tanks T-1 and T-2 is initially verified by limit switches LS-6 and LS-7 and thereafter confirmed by LS-2 and LS-1-A, LS-1-B, and/or LS-1-C. If, for example, LS-6 and LS-7 do not change states immediately after SV-7 and SV-8 close and a fill begins, the fill is aborted and a solution error is annunciated. The inability to fill T-1 or T-2 would typically be the result of the failure of SV-7 or SV-8 to close or the failure of SV-9 to open, or the failure of pump P-2 to operate.

In mixing tank T-3 (having a total capacity of approximately 9½ gallons), level switches LS-3, LS-4-A, LS-4B, and LS-5 (HI/HI, HI, LO, LO/LO respectively) provide for a 3 gallon range (between HI and LO) of available fluid, with adjustable reserve and overflow capacity by moving LS-4A and LS-4B. Three or four batches from tanks T-1 and T-2 are required to refill the mixing tank T-3.

In the event that LS-3 (HI/HI) is reached, power to the chemical pump P-2 is removed, and SV-9, SV-7, and SV-8 are closed. Fail-safe operation tends to be ensured, since solvent availability is curtailed by closure of SV-7 and the turning off of pump P-2. Generally, only the failure of SV-9 to close results in the spillage of any liquid, and that liquid is only water.

In the normal mode, i.e. when no spraying activity is being initiated, there is flow of the wash mixture around a path including mixing tank T-3, supply line 12, wash valve SV-10 (which is a solenoid-operated valve), return line 11, and diaphragm pump P-1. SV-10 is normally closed and is kept open when there is no circulation through unit control boxes to allow flow of the wash mixture through the press supply header 12.

Because P-1 is in the return line, the pumping is done under suction, i.e., at sub-ambient pressure. Although such an arrangement imposes theoretical limits on the maximum pressure (of the order of 14.7 pounds per square inch at atmospheric pressure) that can be developed to pump the wash mixture around the system, these limits are in most cases without practical effect. Instead, this design has the valuable benefit that a leak in the supply line 12 or in the return line 11 is more easily controlled than in situations where pumping is above ambient pressure. Typically, a small leak, for example, might decrease vacuum in the system (by letting air in) and slow down pumping somewhat, but would not cause fluid to get out of the system.

Pump P-1 is air powered. Air for pump P-1 is turned on and off by solenoid valve SV-6; regulation of the air by pressure regulator R-2 regulates the pumping rate. Pump P-1 discharges through valve V-5 directly into mixing tank T-3, and thus agitates fluid in the tank to keep it mixed. Pressure gauge PG-1 provides visual read out of the degree to which suction is present. Strainer ST-3 protects the pump, and strainer ST-1 protects the system plumbing and related components, from foreign matter. Solenoid valve SV-5 is normally opened and can be closed by the system's controller to isolate the tank T-3 from the system, thereby limiting the potential harm resulting from a system leak. Needle valve V-1 permits regulation of flow through the system and the inlet of pump P-1, so that suction remains throughout each pump stroke of P-1. Valve V-1 also ensures that pressure gauge PG-2 and pressure switch PS-2 (normally open) indicate suction when the pump P-1 is in the forward (purge) portion of its stroke. Pressure gauge PG-2 and pressure switch PS-2 are physically very close to tank T-3, which is at ambient pressure, and otherwise would be subject to reaching ambient pressure from time to time. The present configuration is such that loss of suction at PS-2 indicates a system fault, typically a break or blockage between PS-2 and P-1. Such a fault causes the controller to close PS-2 and, after there has elapsed a short interval sufficiently long to purge, with air, the return from the fault and thus to prevent any spillage, the controller turns off pump P-1.

Vacuum of the system is adjusted by valve V-4, which is vented through check valve CV-2 to atmosphere. V-4 and CV-2 are located in the return line at a point sufficiently high to prevent constant closing of CV-2 as a result of head pressure. However, because the pressure is sub-ambient, the position is generally not critical.

FIG. 1 shows the connection of the supply and return lines of unit control boxes 1 and 8 to the supply line 12 and return line 11 of the system. The supply and return lines of the other unit control boxes are similarly connected.

Figure 2:
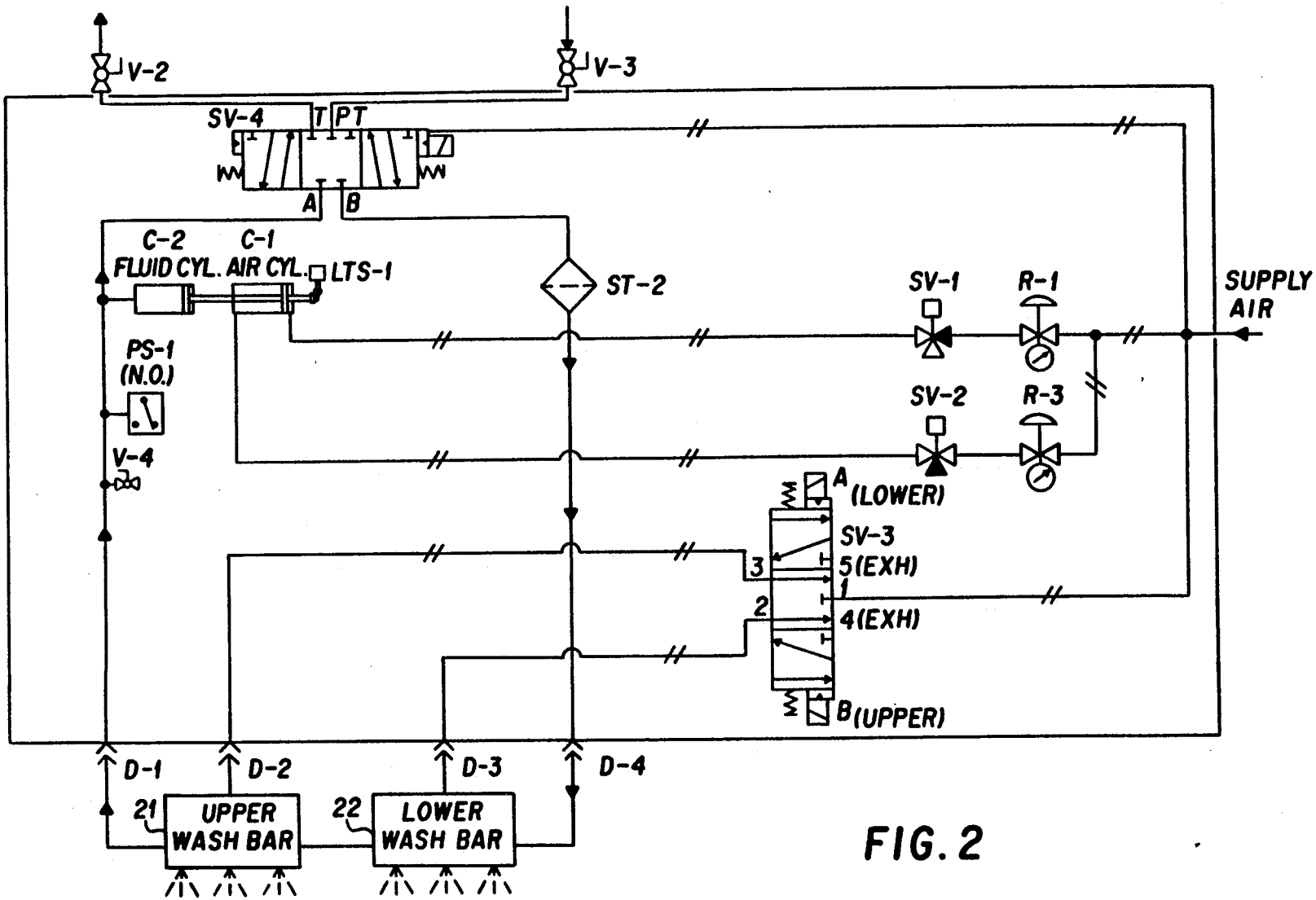
FIG. 2 shows a diagram of fluid flow in a unit control box in accordance with a preferred embodiment of the invention.

FIG. 2 shows a diagram of fluid flow in a unit control box in accordance with a preferred embodiment of the invention. As explained in connection with FIG. 1, normal circulation occurs within the press header through wash valve SV-10 only. The isolation valve arrangement SV-4 (a solenoid-operated valve system) associated with each unit control box is normally closed, isolating the control box from pressure changes and events in the rest of the system. During this time, each box is in the leak-checking mode. In the leak-checking mode, the solenoid valve SV-1 is closed to the air supply and SV-2 is open to the air supply, causing air pressure to enter the left side of air cylinder C-1, and urging its piston to the right. Because the air cylinder's piston is linked to it, the piston of fluid cylinder C-2 is also urged to the right, but neither piston normally reaches the outer limit of possible travel in its respective cylinder. The pull on the fluid cylinder's piston creates a sub-atmospheric pressure within the isolated unit control box/wash bar loop. The degree of vacuum in the isolated unit control box/wash bar loop is a function of the setting of regulator valve R-3. If a leak occurs within that loop, air will be drawn into the loop and the pistons in cylinders C-1 and C-2 will be further displaced, activating limit switch LTS-1, which results in a fault annunciation.

When a splice pre-alarm occurs, or the controller initiates a purge cycle for other reasons, the controller opens the isolation valves of the unit control boxes one valve (and therefore one unit box) at a time. Wash valve SV-10 closes after this cycle is begun, forcing fresh wash mixture seriatim through the boxes. Overlap in time between each box and the next to be purged is maintained to assure that the pump is never starved. In each box, the circulation path is from the supply through the isolation valve SV-4 and strainer ST-2 through the lower and upper wash bars 22 and 21 respectively and back through the isolation valve SV-4 to the return.

After fresh wash mixture has circulated through each of the boxes, the controller prepares for filling of the cylinders C-1 associated with each box. In particular, pump P-1 is turned off, and SV-12 is opened, so as to vent the return line 11 to atmospheric pressure. (To prevent the surge of any fluid outside of the system, the venting path is to the top of tank T-3.) Then, in each unit control box, isolation valve SV-4 opens permitting flow from the press supply header, so that cylinder C-1 (which has been at subambient pressure) fills with fluid, and limit switch LTS-1 is activated. At that time, solenoid valves SV-1 and SV-2 are toggled twice to cause the piston in fluid cylinder C-2 to purge C-2 of any air and old fluid and then to draw in freshly circulated fluid. This process is carried out simultaneously for all unit control boxes. Thereafter the isolation valve SV-4 is closed, vent valve SV-12 is closed, wash valve SV-10 is opened, and pump P-1 is restarted, permitting renewed circulation (outside of the isolated unit control boxes) at subambient pressure.

Immediately prior to the spraying of fluid by upper and lower wash bars 21 and 22 respectively, the contained volume of fluid in the isolated unit control box is pressurized. Pressurization is achieved by toggling SV-1 and SV-2, so that they are open and closed respectively, causing air pressure to urge the piston in air cylinder C-1 to the left, with the consequence that the piston in cylinder C-2 is also urged to the left. The fluid pressure in the isolated unit control box is a function of the air supply pressure and the setting of regulator valve R-1; a typical pressure for spraying is of the order of approximately 40 lbs/sq. in. In the pressure mode, the closure of normally open pressure switch PS-1 verifies the presence of spray pressure, and therefore confirms the seating of solenoid isolation valve SV-4, and the leak integrity of the bars and other unit control box components.

Upper and lower bars are configured in the general manner described in abandoned application Ser. No. 134,218, filed Dec. 16, 1987. The bars permit axial flow of fluid therethrough. Each bar includes a plurality of nozzles, each of which has associated therewith a normally closed pneumatic valve in the fluid path between the bar and the nozzle. Each half of solenoid valve SV-3 is activated separately to open the nozzles of one wash bar at a time to cause the bar to spray onto the blanket. (For this purpose, the volume of cylinder C-2 is established for the system in such a way that it holds sufficient fluid to sustain the spray of fluid by both bars. Depending on the width of the bar and the spray duration, a typical volume is 75–200 cc.)

When a wash cycle is completed, the pistons in cylinders C-2 and C-1 have not quite bottomed out and pressure remains in the unit control box volume. To relieve this pressure, solenoid isolation valve SV-4 is momentarily opened. Thereafter, SV-4 is closed to isolate the box from the rest of the system, and the controller causes the unit box to revert to the leak-checking mode described above, as solenoid valves SV-1 and SV-2 are toggled to cause the piston in cylinder C-2 to pull the pressure in the isolated box below ambient.

Figure 4A:
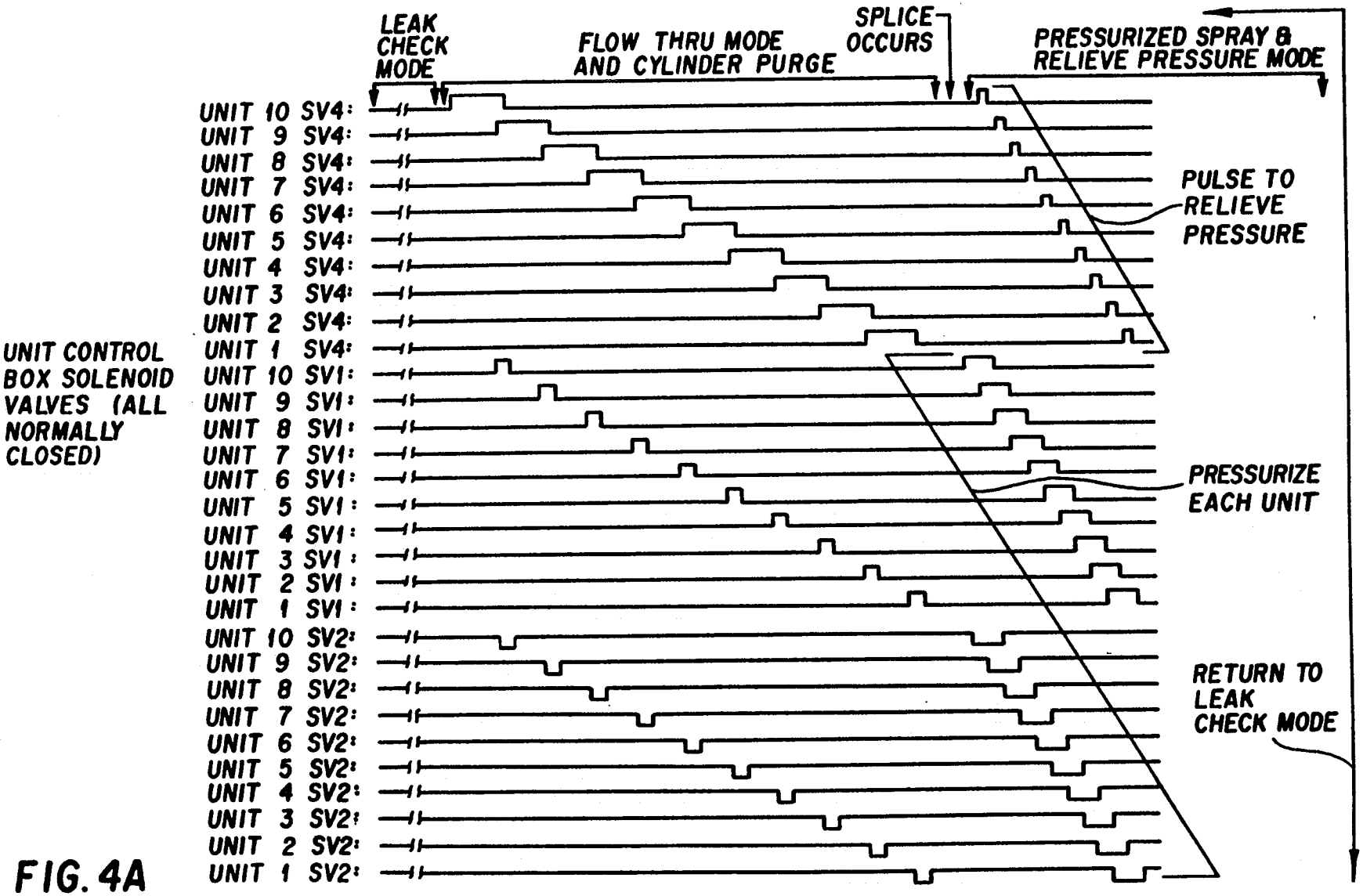
FIG. 4 shows a timing diagram for an embodiment of the invention similar to that illustrated in FIGS. 1–3 but with ten unit control boxes.
Figure 4B:
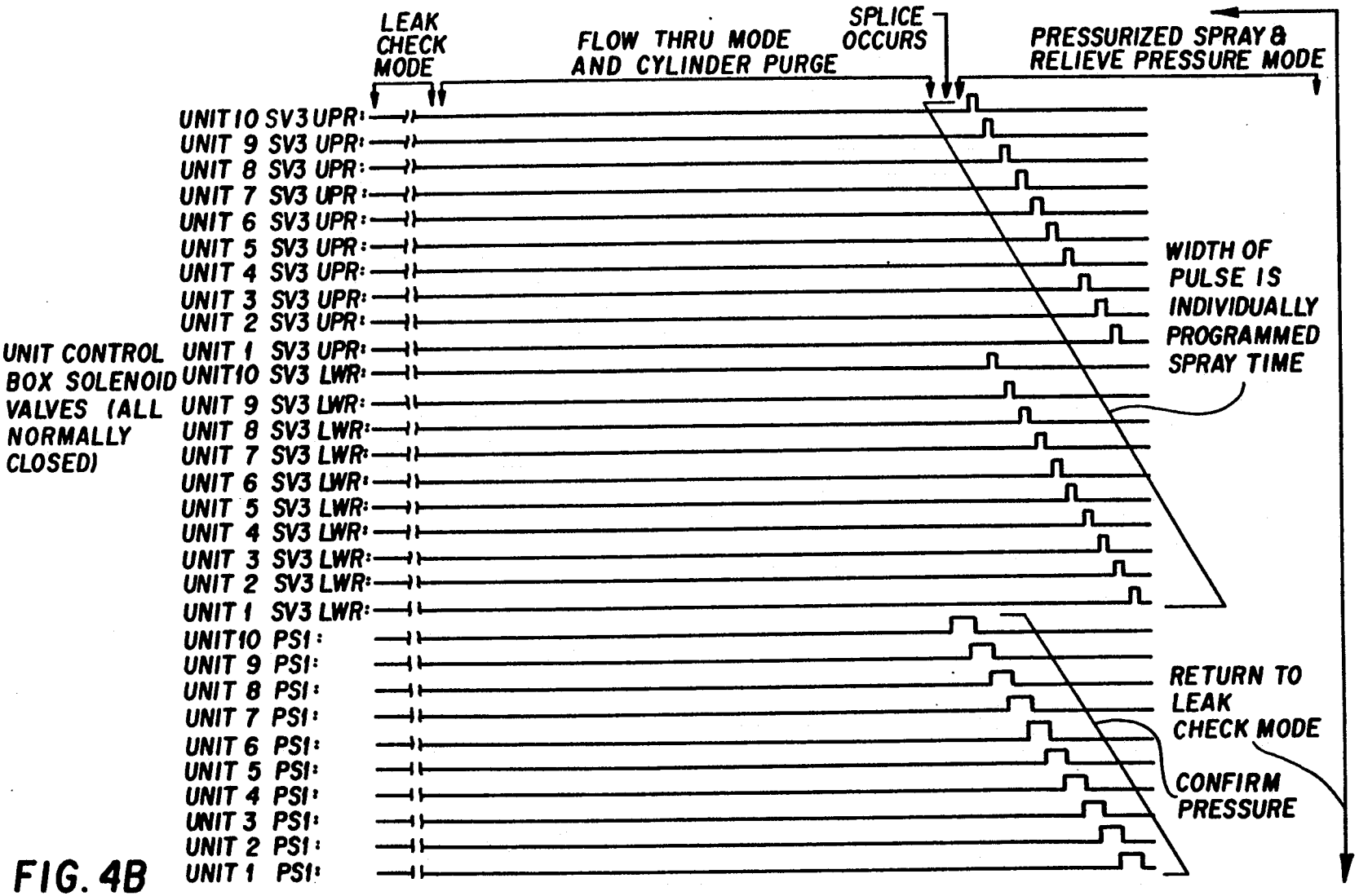
Figure 4C:
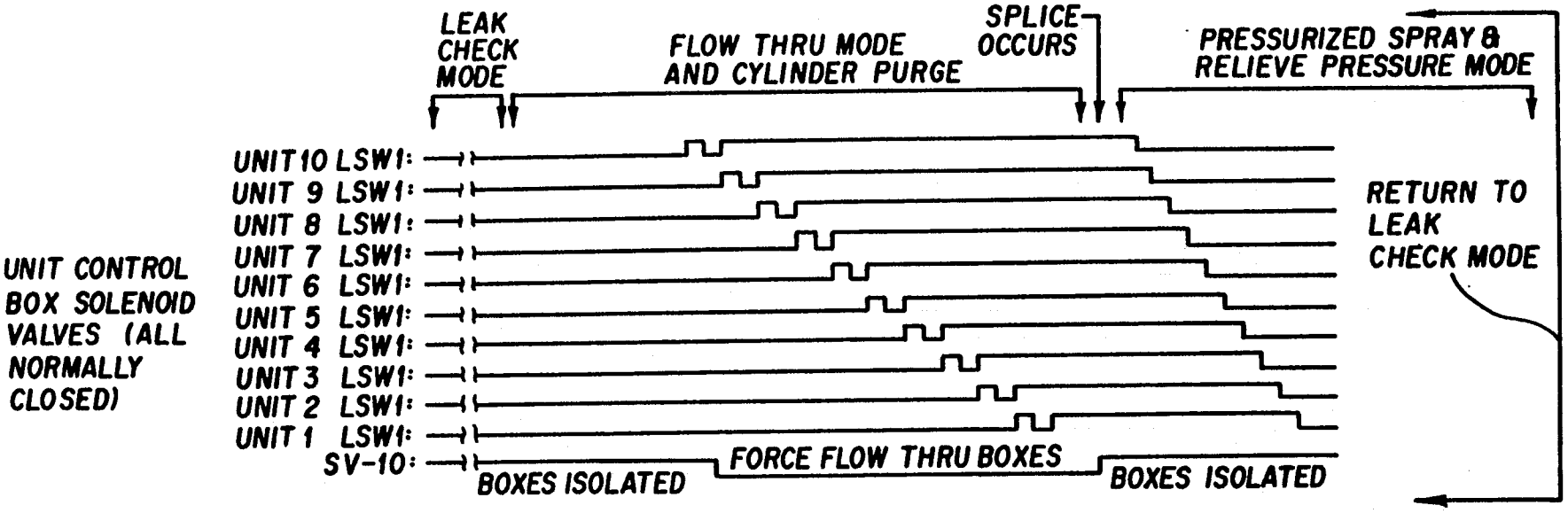

FIG. 3 shows the states of the main valves and switches described above in the course of a wash cycle. The cycle described above for a single unit control box is repeated for each of the unit control boxes in the system. FIG. 4 shows a timing diagram for an embodiment of the invention similar to that described in connection with FIGS. 1–3 but with ten unit control boxes. As can be seen in FIG. 4, the cycle in one unit control box need not be completed before initiation of the cycle in the next successive unit control box. The commencement of successive cycles may be staggered in the manner indicated.

Because spraying by a unit control box occurs when the unit's isolation valve is closed, each box's spray cycle can be conducted with considerable independence from that of the other boxes, with the result that there can be considerable departure from the configuration of cycles depicted in FIG. 4. It is even possible, for example, to cause only some boxes to spray, over the course of a system cycle, to deal with blankets that become dirty more quickly, while excluding other boxes from spraying. Similarly, although the timing diagram shows that in the course of forcing fluid flow through the boxes, there is an interval when only one isolation valve SV-4 at a time is open (to maximize the fluid pressure from pump P-1 in the box loop), it is within the scope of the invention to cause pumping of fluid through a selected plurality of boxes simultaneously.

Figure 5:
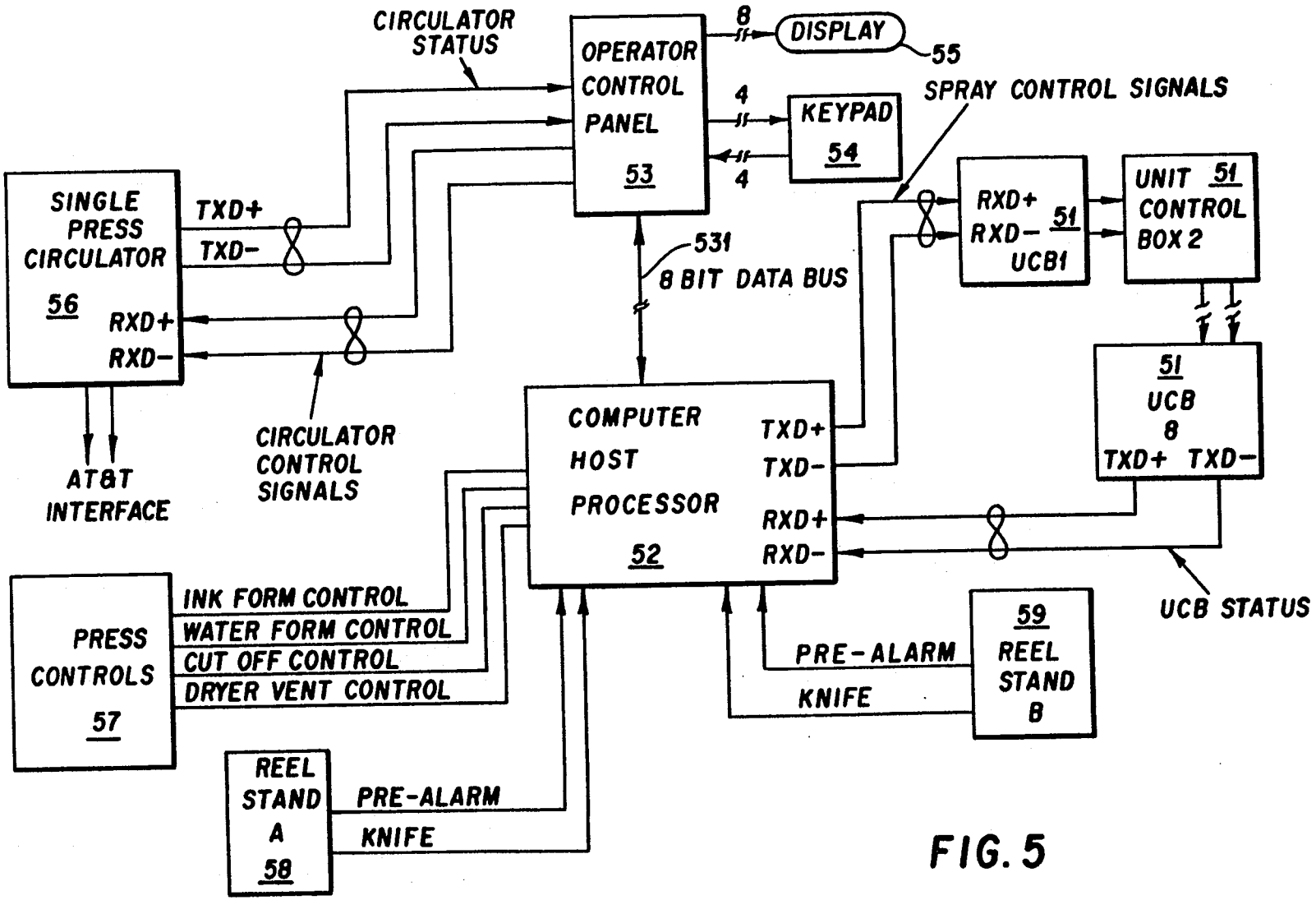
FIG. 5 shows a block diagram for logical control of the embodiment of FIGS. 1–3.
Figure 6:
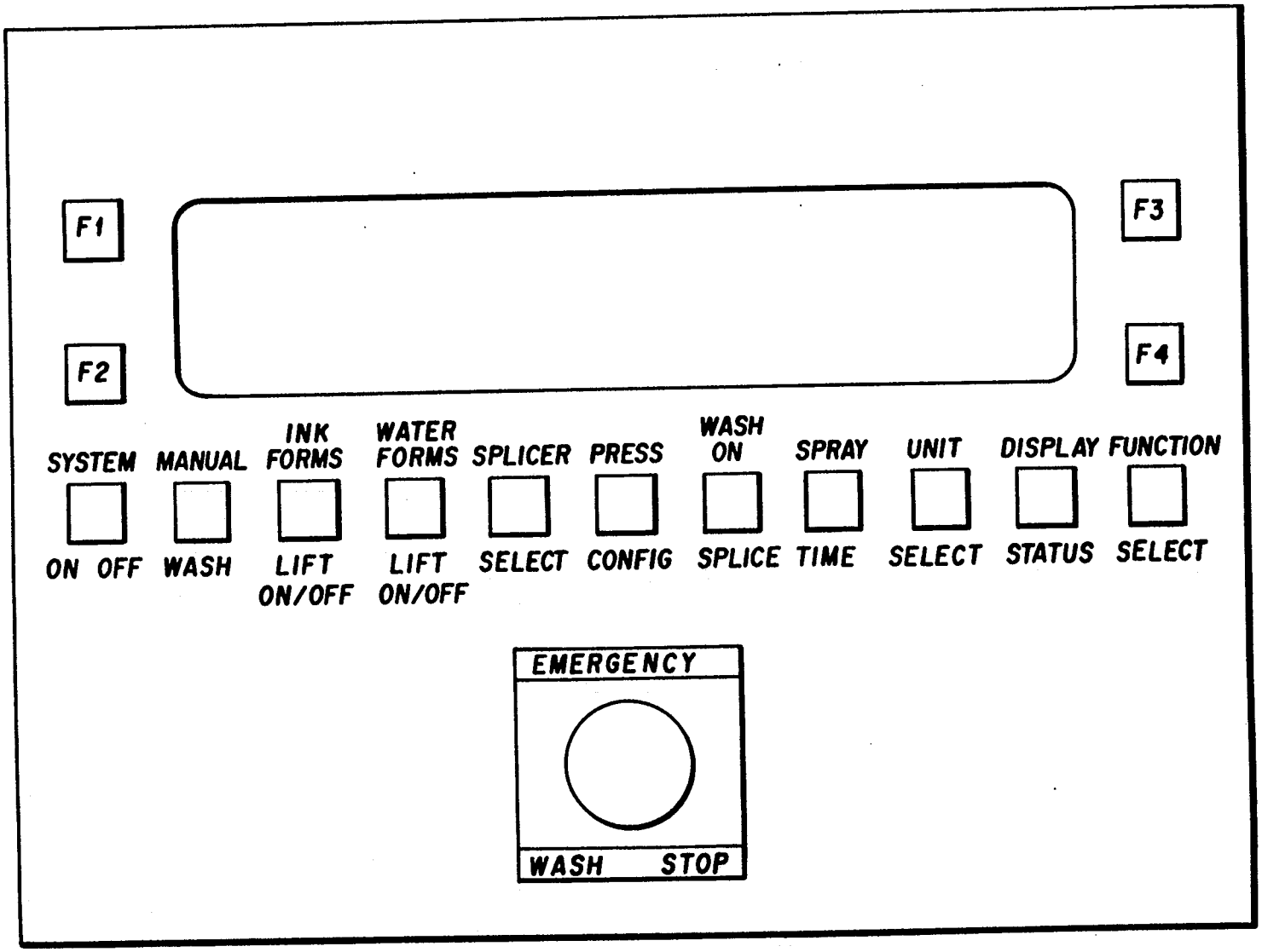
FIG. 6 illustrates a front panel of the controller box for the embodiment of FIGS. 1–3.

FIG. 5 shows a block diagram for logical control of the embodiment of FIGS. 1–3. As discussed above, the particular implementation of the controller is not critical. In the embodiment shown here each unit control box has its own controller 51, and the controllers 51 are in a communications loop with a host processor 52, permitting spray control signals from the host processor to be passed successively from one controller 51 to the next and to inform the host processor 52 of the status of the controllers 51. The host processor 52 has a data bus 531 in communication with a control panel 53 having an associated keypad 54 and display 55. The control panel 53 is in communication with the circulator 56 (described in connection with FIG. 1) for control and status indication. The host processor 52 is also in communication with press controls 57 and paper reel stands 58 and 59 for receipt of knife and splice pre-alarm signals. The control panel 53 is illustrated in FIG. 6.

What is claimed is:

1. A system for automatically cleaning a component of a printing press, the system being located in an environment having an ambient pressure, the system comprising:

source means for providing a reservoir of a fluid wash mixture;

supply and return lines in fluid communication with the source means;

spray means for spraying wash mixture onto the component, the spray means being in fluid communication with the source means and receiving wash mixture from the source means via the supply line;

circulation means for circulating wash mixture around a path including the source means and at least a portion of each of the supply and return lines in such a way that pressure in the supply line can never exceed the ambient pressure outside the system.

2. A system according to claim 1, wherein the circulation means includes a pump disposed in the return line.

3. A system according to claim 2, wherein the spray means includes a fluid input and a fluid output, a first fluid path therebetween, and a plurality of nozzles, each nozzle in fluid communication with the first fluid path and having a valve associated therewith disposed between the first fluid path and such nozzle.

4. A system according to claim 3, wherein the fluid input of the spray means is connected to the supply line and the fluid output is connected to the return line.

5. A system according to claim 4, wherein the spray means includes first valve means in the first fluid path for in an open state permitting and in a closed state preventing fluid flow between the fluid input and fluid output.

6. A system according to claim 5, further comprising: second valve means disposed between the supply and return lines for in an open state permitting and in a closed state preventing direct fluid flow therebetween.

7. A system according to claim 6, further comprising: control means for causing the system to be in a first state wherein the first and second valve means are in open and closed states respectively and in a second state wherein the first and second valve means are in closed and open states respectively.

8. A system for automatically cleaning a component of a printing press, the system comprising:

source means for providing a reservoir of a fluid wash mixture;

supply and return lines in fluid communication with the source means;

circulation means for circulating wash mixture around a path including the source means and at least a portion of each of the supply and return lines; and spray means for spraying wash mixture onto the component, the spray means being in fluid communication with the source means and receiving wash mixture from the source means via the supply line, the spray means including (i) a feed region in fluid communication with the source means, (ii) a plurality of nozzles in fluid communication with the feed region; (iii) isolation valve means for in a open state permitting and in a closed state preventing fluid pressure transmission from the rest of the system to the feed region; and (iv) pressure means for modifying fluid pressure in the feed region by changing the volume of the feed region when the isolation valve means is in a closed state.

9. A system according to claim 8, wherein the pressure means has a first mode for increasing fluid pressure in the feed region when the isolation valve means is in a closed state and a second mode for decreasing fluid pressure in the feed region when the isolation valve means is in a closed state.

10. A system for automatically cleaning a component of a printing press, the system comprising:

source means for providing a reservoir of a fluid wash mixture;

supply and return lines in fluid communication with the source means;

circulation means for circulating wash mixture around a path including the source means and at least a portion of each of the supply and return lines; and spray means for spraying wash mixture onto the component, the spray means being in fluid communication with the source means and receiving wash mixture from the source means via the supply line, the spray means including Ii) a feed region in fluid communication with the source means, (ii) a plurality of nozzles in fluid communication with the feed region; (iii) isolation valve means for in a open state permitting and in a closed state preventing fluid pressure transmission from the rest of the system to the feed region; and (iv) pressure means for modifying fluid pressure in the feed region when the isolation valve means is in a closed state, wherein the pressure means has a first mode for increasing fluid pressure in the feed region when the isolation valve means is in a closed state and a second mode for decreasing fluid pressure in the feed region when the isolation valve means is in a closed state, and wherein the pressure means includes a fluid cylinder in fluid communication with the feed region, a piston disposed within the fluid cylinder, and biasing means for causing the fluid cylinder piston to be biased in a first direction when the pressure means is in the first mode and biased in a second direction when the pressure means is in the second mode.

11. A system according to claim 10, wherein the biasing means includes (i) an air cylinder having a piston disposed therein and linked to the fluid cylinder piston, the air cylinder piston having first and second faces, the air cylinder having first and second ports in communication with the first and second faces respectively and (ii) air supply means for supplying air pressure to the first port when the pressure means is in the first mode and to the second port when the pressure means is in the second mode, the fluid pressure in the feed region in each case being a function of the air pressure supplied by the air supply means.

12. A system according to claim 10, further comprising:

first leak detection means for sensing the limit of travel of the piston in the second direction.

13. A system according to claim 8, further comprising:

a plurality of spray means, each as defined in claim 8, and further including a fluid input and a fluid output, and a first fluid path therebetween, and wherein the pressure means further includes means for increasing the fluid pressure in the feed region prior to the spraying by the nozzles and wherein each of the spray means has its first input connected to the supply line and its fluid output connected to the return line, so that fluid in each spray means may be sprayed by the nozzles associated therewith independently of pressure conditions elsewhere in the system.

14. A system for automatically cleaning components of a printing press, the system comprising:

source means for providing a reservoir of a fluid wash mixture;

supply and return lines in fluid communication with the source means;

circulation means for circulating wash mixture around a path including the source means and at least a portion of each of the supply and return lines;

a plurality of spray means for spraying wash mixture onto the components, each spray means being in fluid communication with the source means and receiving wash mixture from the source means via the supply line, each spray means including Ii) a feed region in fluid communication with the source means, (ii) a plurality of nozzles in fluid communication with the feed region; (iii) isolation valve means for in an open state permitting and in a closed state preventing fluid pressure transmission from the rest of the system to the feed region; and (iv) pressure means for modifying fluid pressure in the feed region when the isolation valve means is in a closed state;

each spray means further including a fluid input and a fluid output, and a first fluid path therebetween, and wherein the pressure means further includes means for increasing the fluid pressure in the feed region prior to the spraying by the nozzles and wherein each of the spray means has its first input connected to the supply line and its fluid output connected to the return line, so that fluid in each spray means may be sprayed by the nozzles associated therewith independently of pressure conditions elsewhere in the system;

wash valve means disposed between the supply and return lines for in an open position permitting and in a closed position restricting flow between the supply and return lines; and control means for implementing a cycle as follows:

(a) with the isolation valve means of each spray means in a closed state and the wash valve means in an open position, permitting the circulation means to circulate wash mixture around a path including the wash valve means;

(b) with the wash valve means in a closed position and at least one of the isolation valve means of the spray means in an open state, permitting the circulation means to circulate wash mixture around a path including at least one of the spray means; and (c) with at least one of the isolation valve means of the spray means in a closed state, permitting the pressure means in such spray means to increase pressure in the feed region prior to the spraying by the nozzles;

(d) spraying fluid through the nozzles associated with each spray means having increased pressure in the feed region thereof; and (e) repeating steps (b) through (e) until fluid has been sprayed by each of the spray means.

15. A system according to claim 14, wherein the control means includes means for implementing step (b) of the cycle separately with respect to each spray means in such a way that circulation occurs through only relatively few spray means at a time.

16. A system according to claim 15, wherein the control means includes means for implementing step (b) of the cycle separately with respect to each spray means in such a way that circulation occurs through only one spray means at a time.

17. A system according to claim 14, wherein the pressure means of each spray means has a first mode for increasing fluid pressure in the feed region when the isolation valve means is in a closed state and a second mode for decreasing fluid pressure in the feed region when the isolation valve means is in a closed state and the cycle includes, during at least a portion of step (a), the step of causing the pressure means to decrease the fluid pressure in the feed region of each of the spray means.

18. A system for automatically cleaning a component of a printing press, the system being located in an environment having an ambient pressure, the system comprising:

source means for providing a reservoir of a fluid wash mixture;

supply and return lines in fluid communication with the source means;

spray means for spraying wash mixture onto the component, the spray means being in fluid communication with the source means and receiving wash mixture from the source means via the supply line, the spray means including Ii) a feed region in fluid communication with the source means, (ii) a plurality of nozzles in fluid communication with the feed region; (iii) isolation valve means for in an open state permitting and in a closed state preventing fluid pressure transmission from the rest of the system to the feed region; and (iv) pressure means for modifying fluid pressure in the feed region when the isolation valve means is in a closed state; and circulation means for circulating wash mixture around a path including the source means and at least a portion of each of the supply and return lines in such a way that pressure in the supply line can never exceed the ambient pressure outside the system.

19. A system according to claim 18, wherein the circulation means includes a pump disposed in the return line.

20. A system according to claim 19, further comprising:

wash valve means disposed between the supply and return lines for in an open state permitting and in a closed state preventing direct fluid flow therebetween.

21. A system according to claim 20, further comprising:

control means for causing the system to be in a first state wherein the isolation and wash valve means are in open and closed states respectively and in a second state wherein the isolation and wash valve means are in closed and open states respectively.

22. A system for automatically cleaning a component of a printing press, the system being located in an environment having an ambient pressure, the system comprising:

source means for providing a reservoir of a fluid wash mixture;

supply and return lines in fluid communication with the source means;

circulation means for circulating wash mixture around a path including the source means and at least a portion of each of the supply and return lines;

spray means for spraying wash mixture onto the component, the spray means being in fluid communication with the source means and receiving wash mixture from the source means via the supply line, the spray means including (i) a feed region in fluid communication with the source means, (ii) a plurality of nozzles in fluid communication with the feed region; (iii) isolation valve means for in an open state permitting and in a closed state preventing fluid pressure transmission from the rest of the system to the feed region; and (iv) pressure means for modifying fluid pressure in the feed region when the isolation valve means is in a closed state, wherein the pressure means has a (a) first mode for increasing fluid pressure in the feed region when the isolation valve means is in a closed state so as to permit spraying, and (b) a second mode for decreasing fluid pressure in the feed region to less than the ambient pressure outside the system when the isolation valve means is in a closed state.

23. A system according to claim 22, wherein the pressure means includes a fluid cylinder in fluid communication with the feed region, a piston disposed within the fluid cylinder, and biasing means for causing the fluid cylinder piston to be biased in a first direction when the pressure means is in the first mode and biased in a second direction when the pressure means is in the second mode.

24. A system according to claim 23, wherein the biasing means includes Ii) an air cylinder having a piston disposed therein and linked to the fluid cylinder piston, the air cylinder piston having first and second faces, the air cylinder having first and second ports in communication with the first and second faces respectively and (ii) air supply means for supplying air pressure to the first port when the pressure means is in the first mode and to the second port when the pressure means is in the second mode, the fluid pressure in the feed region in each case being a function of the air pressure supplied by the air supply means.

25. A system according to claim 23, further comprising:

first leak detection means for sensing the limit of travel of the piston in the second direction.

26. A system according to claim 22, further comprising:

a plurality spray means, each as defined in claim 22, and further including a fluid input and a fluid output, and a first fluid path therebetween, and wherein the pressure means further includes means for increasing the fluid pressure in the feed region prior to the spraying by the nozzles and wherein each of the spray means has its first input connected to the supply line and its fluid output connected to the return line, so that fluid in each spray means may be sprayed by the nozzles associated therewith independently of pressure conditions elsewhere in the system.

27. A system according to claim 26, further comprising:

wash valve means disposed between the supply and return lines for in an open position permitting and in a closed position restricting flow between the supply and return lines; and control means for implementing a cycle as follows:

(a) with the isolation valve means of each spray means in a closed state and the wash valve means in an open position, permitting the circulation means to circulate wash mixture around a path including the wash valve means;

(b) with the wash valve means in a closed position and at least one of the isolation valve means of the spray means in an open state, permitting the circulation means to circulate wash mixture around a path including at least one of the spray means; and (c) with at least one of the isolation valve means of the spray means in a closed state, permitting the pressure means in such spray means to increase pressure in the feed region prior to the spraying by the nozzles;

(d) spraying fluid through the nozzles associated with each spray means having increased pressure in the feed region thereof; and (e) repeating steps (b) through (e) until fluid has been sprayed by each of the spray means.

28. A system according to claim 22, wherein the pressure means includes means for changing the pressure in the feed region by changing the volume of the feed region when the isolation valve means is in a closed state.

* * * * *